US009206577B2

(12) United States Patent
Lusk

(10) Patent No.: US 9,206,577 B2
(45) Date of Patent: Dec. 8, 2015

(54) IMPACT TOOL ASSEMBLY AND METHOD OF ASSEMBLING SAME

(75) Inventor: Jeremy Lusk, Spring Creek, NV (US)

(73) Assignee: DYNAMATIC SOLUTIONS, LLC, Henderson, NV (US)

( * ) Notice: Subject to any disclaimer, the term of this patent is extended or adjusted under 35 U.S.C. 154(b) by 833 days.

(21) Appl. No.: 13/469,451

(22) Filed: May 11, 2012

(65) Prior Publication Data

US 2012/0285714 A1 Nov. 15, 2012

Related U.S. Application Data

(60) Provisional application No. 61/485,042, filed on May 11, 2011.

(51) Int. Cl.
*E02D 7/04* (2006.01)

(52) U.S. Cl.
CPC ..... *E02D 7/04* (2013.01); *Y10T 29/4984* (2015.01)

(58) Field of Classification Search
CPC ..... E02D 7/04; E02D 3/046; Y10T 29/5393; B25B 19/00; B25B 5/02
See application file for complete search history.

(56) References Cited

U.S. PATENT DOCUMENTS

| | | | | |
|---|---|---|---|---|
| 797,824 | A * | 8/1905 | Seitz | 30/367 |
| 874,499 | A | 12/1907 | Gunn | |
| 1,572,046 | A * | 2/1926 | Seiler | 30/367 |
| 1,965,177 | A | 7/1934 | Finkl | |
| 2,490,684 | A * | 12/1949 | Gosselin | 30/277 |
| 2,594,901 | A * | 4/1952 | Forster | 173/31 |
| 2,684,839 | A | 7/1954 | Rice | |
| 2,787,178 | A * | 4/1957 | Maxim | 173/203 |
| 3,036,482 | A | 5/1962 | Kenworthy et al. | |
| 3,071,994 | A | 1/1963 | Swenson | |
| 3,735,822 | A | 5/1973 | Deike | |
| 3,747,690 | A | 7/1973 | Deike | |
| 3,783,956 | A | 1/1974 | Schultz | |
| 3,792,739 | A | 2/1974 | Deike | |
| 3,841,418 | A | 10/1974 | Biersack | |
| 3,900,058 | A | 8/1975 | McArdle | |
| 3,905,103 | A | 9/1975 | Ford et al. | |
| 4,470,440 | A | 9/1984 | Thor | |

(Continued)

FOREIGN PATENT DOCUMENTS

AT 005 840 U1 12/2002

OTHER PUBLICATIONS

International Search Report and Opinion Opinion mailed Sep. 24, 2012.

*Primary Examiner* — Andrew M Tecco
(74) *Attorney, Agent, or Firm* — Howard & Howard Attorneys PLLC

(57) ABSTRACT

A tool assembly is described herein. The tool assembly includes a housing assembly that includes a first end, a second end, and an inner surface that defines a cavity that extends between the first end and the second end along a longitudinal axis. A rod assembly is slideably coupled to the housing assembly and is orientated within the housing cavity such that a portion of the rod assembly extends outwardly from the housing first end. An impact assembly is positioned within the housing cavity and is orientated between the rod assembly and the housing second end. The tool assembly is operable in a first operating mode wherein the rod assembly is movable with respect to the impact assembly, and a second operating mode wherein the impact assembly contacts the rod assembly to move the rod assembly outwardly from the housing.

16 Claims, 8 Drawing Sheets

(56) References Cited

U.S. PATENT DOCUMENTS

| | | | | | |
|---|---|---|---|---|---|
| 4,709,765 | A | * | 12/1987 | Campanell | 173/202 |
| 4,919,216 | A | * | 4/1990 | Ikegami | 173/93.6 |
| 5,461,992 | A | | 10/1995 | Scollard | |
| 5,827,290 | A | * | 10/1998 | Bradley | 606/86 R |
| 6,010,508 | A | * | 1/2000 | Bradley | 606/86 R |
| 6,032,849 | A | | 3/2000 | Mastri et al. | |
| 6,109,365 | A | | 8/2000 | Lamoureux et al. | |
| 6,164,393 | A | | 12/2000 | Bakke | |
| 6,257,093 | B1 | * | 7/2001 | Bergacker | 81/20 |
| 6,349,776 | B1 | | 2/2002 | Hus | |
| 6,370,993 | B1 | * | 4/2002 | Pitstick | 81/463 |
| 6,386,078 | B1 | * | 5/2002 | Wu | 81/463 |
| 6,829,966 | B1 | | 12/2004 | Bramuchi | |
| 6,986,394 | B2 | | 1/2006 | Marsh | |
| 2005/0211452 | A1 | | 9/2005 | Andersen | |
| 2005/0241842 | A1 | | 11/2005 | Marsh | |
| 2012/0024117 | A1 | * | 2/2012 | Kreutzer | 81/463 |

* cited by examiner

IMPACT TOOL ASSEMBLY AND METHOD OF ASSEMBLING SAME

CROSS-REFERENCE TO RELATED APPLICATIONS

This application claims the benefit of U.S. Provisional Application No. 61/485,042, filed May 11, 2011, the disclosure of which is incorporated herein by reference.

FIELD OF THE INVENTION

The present invention relates generally to a tool assembly, and more particularly, to a tool assembly that is operable between a tamping mode of operation and a driving mode of operation.

BACKGROUND OF THE INVENTION

At least some known tamping tools include a tamping plate that is coupled to a rod assembly. Known tamping tools are configured to enable the user to lift the tamping tool above a ground surface and thrust the tamping tool into the ground surface to impart an axial force to the ground surface to facilitate compacting the ground surface. These tamping tools require a high level of exertion from the user by requiring the user to repeatedly lift the tamping tool above the ground to deliver the compacting blow.

At least some known compaction tools includes a pneumatic assembly and/or a gas powered engine that enables the compaction tools to vibrate or bounce along the ground surface to facilitate compacting the ground surface. These compaction tools require an air supply and/or fuel to enable operation of the compaction tools, which increases an operational cost of the compaction tool. In addition, known compaction tools are heavy, and require significant effort from the use to control the direction and operation of the compaction tool.

As such, it is desirable to provide a tool assembly that reduces the effort of the user to compact a ground surface, and reduces an operating cost over known compaction tools. The present invention is aimed at the problem identified above.

SUMMARY OF THE INVENTION

In one aspect of the present invention, a tool assembly is provided. The tool assembly includes a housing assembly that includes a first end, a second end, and an inner surface that defines a cavity that extends between the first end and the second end along a longitudinal axis. A rod assembly is slideably coupled to the housing assembly and is orientated within the housing cavity such that a portion of the rod assembly extends outwardly from the housing first end. An impact assembly is positioned within the housing cavity and is orientated between the rod assembly and the housing second end. The impact assembly is configured to selectively contact the rod assembly to move the rod assembly along the longitudinal axis. The tool assembly is operable in a first operating mode wherein the rod assembly is movable with respect to the impact assembly and a second operating mode wherein the impact assembly contacts the rod assembly to move the rod assembly outwardly from the housing.

In another aspect of the present invention, a tool assembly is provided. The tool assembly includes a housing assembly that includes a cavity that extends between a first end and a second end, and a rod assembly that is slideably coupled to the housing assembly. The rod assembly is orientated within the housing cavity such that a portion of the rod assembly extends outwardly from the housing first end. An impact assembly is positioned within the housing cavity and is movable between a first position and a second position along a longitudinal axis. A mode selector assembly is coupled to the housing and is configured to selectively contact the impact assembly to operate the tool assembly in a first operating mode and a second operating mode. The impact assembly is positioned at the first position in the first operating mode and is movable between the first position and the second position to contact the rod assembly in the second operating mode.

In yet another embodiment, a method of assembling a tool assembly is provided. The method includes providing a housing assembly that includes a first end, a second end, and an inner surface that defines a cavity that extends between the first end and the second end along a longitudinal axis. A rod assembly is slideably coupled to the housing. The rod assembly is at least partially positioned within the housing cavity and orientated along the longitudinal axis such that at least a portion of the rod assembly extends outwardly from the housing first end. An impact assembly is slideably coupled to the housing assembly. The impact assembly is positioned within the housing cavity and orientated between the rod assembly and the housing second end. The impact assembly is configured to selectively contact the rod assembly to move the rod assembly along the longitudinal axis such that the tool assembly is operable in a first operating mode wherein the rod assembly is movable with respect to the impact assembly and a second operating mode wherein the impact assembly contacts the rod assembly to move the rod assembly outwardly from the housing first end.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE INVENTION

The exemplary apparatus and methods described herein overcome at least some disadvantages of known compaction tools by providing a tool assembly that enables a user to manually operate the tool assembly to deliver an axial force to a ground surface. The tool assembly that is selectively operable between a tamping mode wherein the tool assembly impacts a first axial force to a ground surface, and a driving mode, wherein the tool assembly imparts the first axial force and a second axial force to the ground surface. In addition, the tool assembly includes a rod assembly that is slideably coupled to a housing assembly, and is configured to bias the housing assembly from the ground surface to enable the user to operate the tool assembly in a reciprocating motion, and to reduce an effort required to compact the ground surface over known compaction tools. By providing a tool assembly that operates in a plurality of operational modes, and that is operated in a reciprocating motion, the effort required to impart a force to the ground surface is reduced.

In general, the tool assembly 10 includes a rod assembly and an impact assembly and is operable between a tamping mode and a driving mode. In the tamping mode, the rod assembly moves axially along a longitudinal axis with the impact assembly in a stationary position to impart an axial force to a ground surface. In the driving mode, the rod assembly moves imparts a first axial force to the ground surface and engages the impact assembly to move the impact assembly along the longitudinal axis to generate a second axial force. Upon reaching a predefined axial location, the impact assembly disengages the rod assembly, rapidly moves along the longitudinal axis, and strikes the rod assembly to impart the generated second axial force to the rod assembly and the ground surface.

Figure 1:
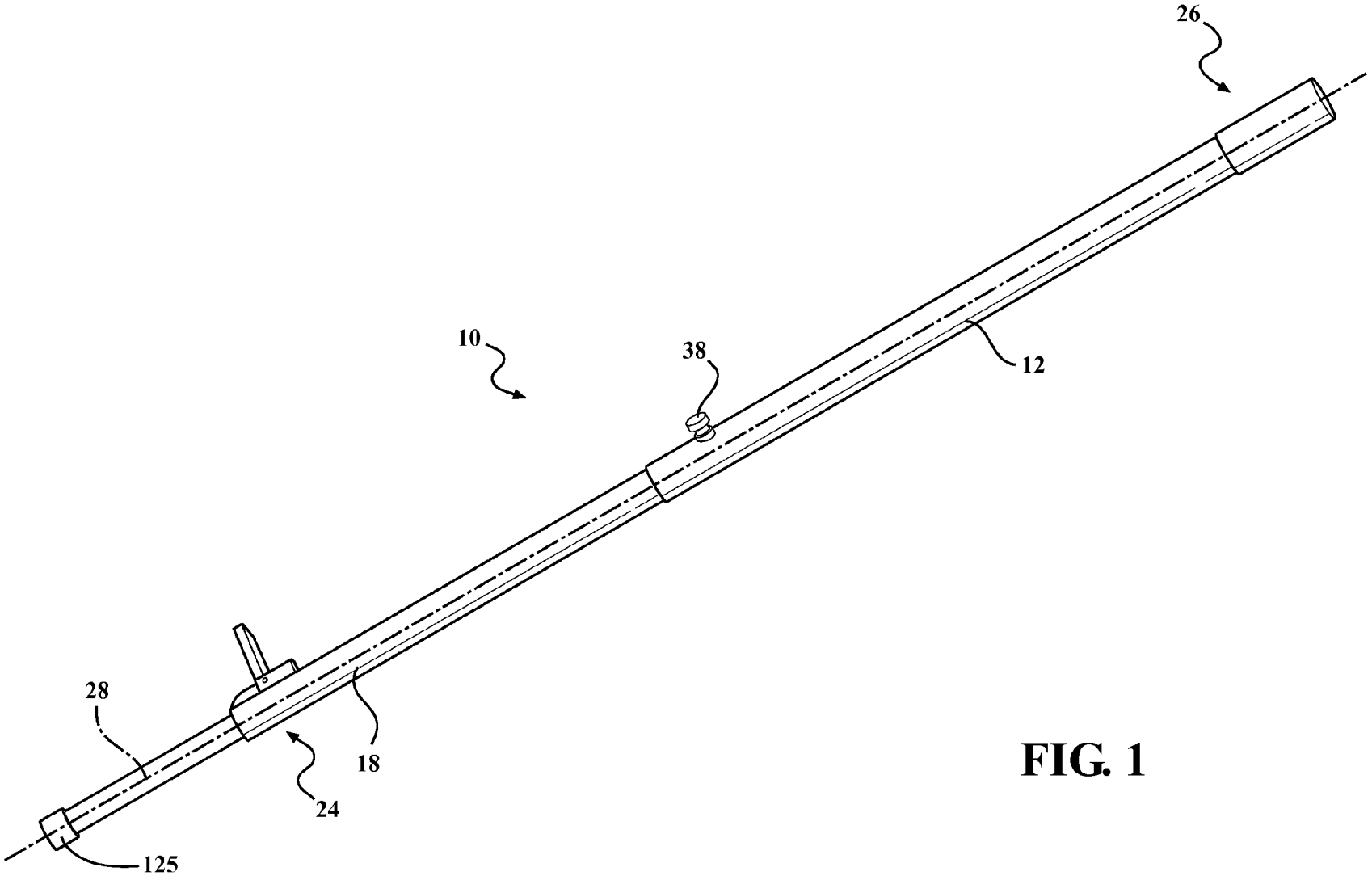
FIG. 1 is a perspective view of a tool assembly, according to an embodiment of the present invention.
Figure 2:
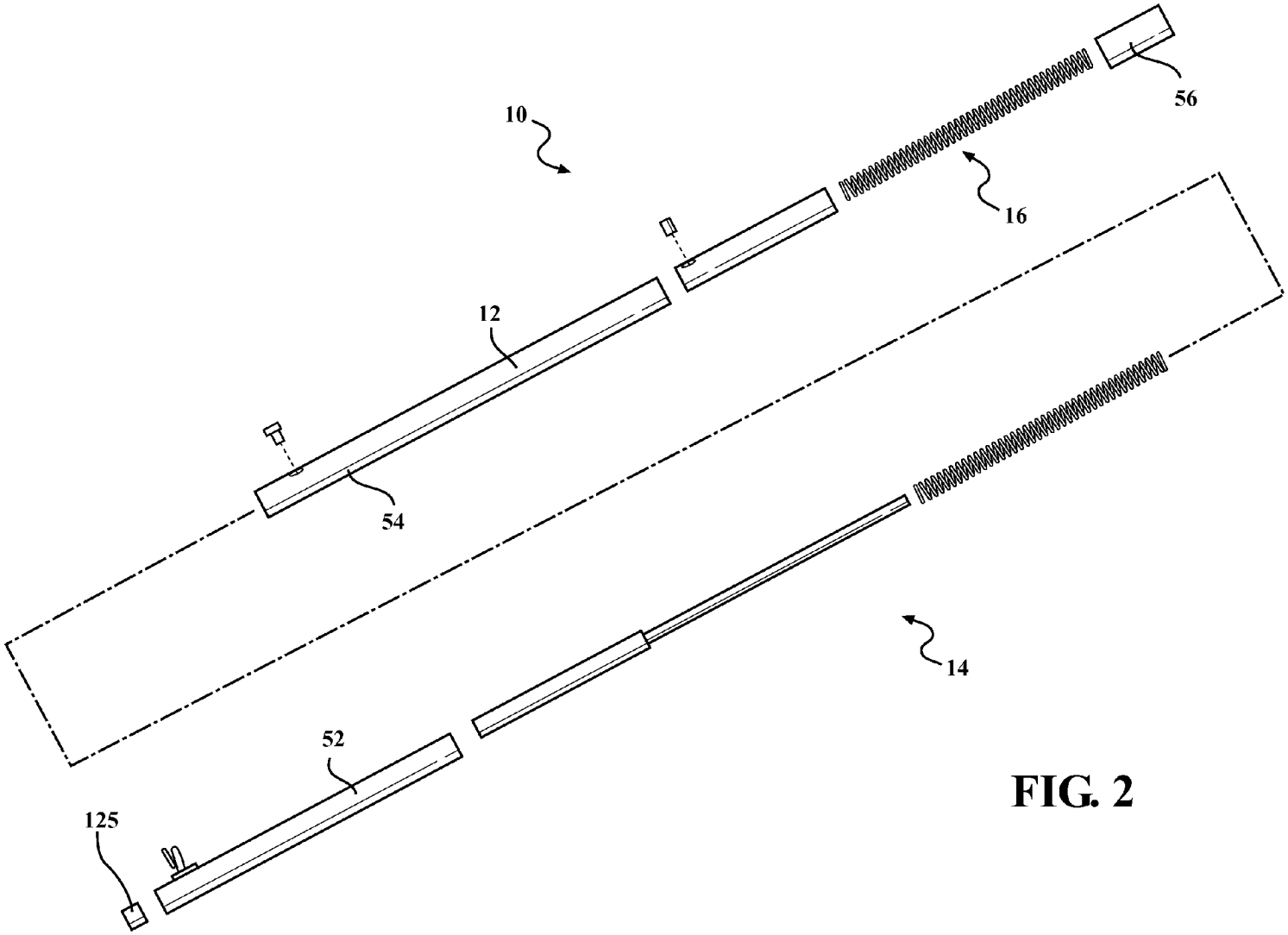
FIG. 2 is an exploded perspective view of the tool assembly shown in FIG. 1.
Figure 3:
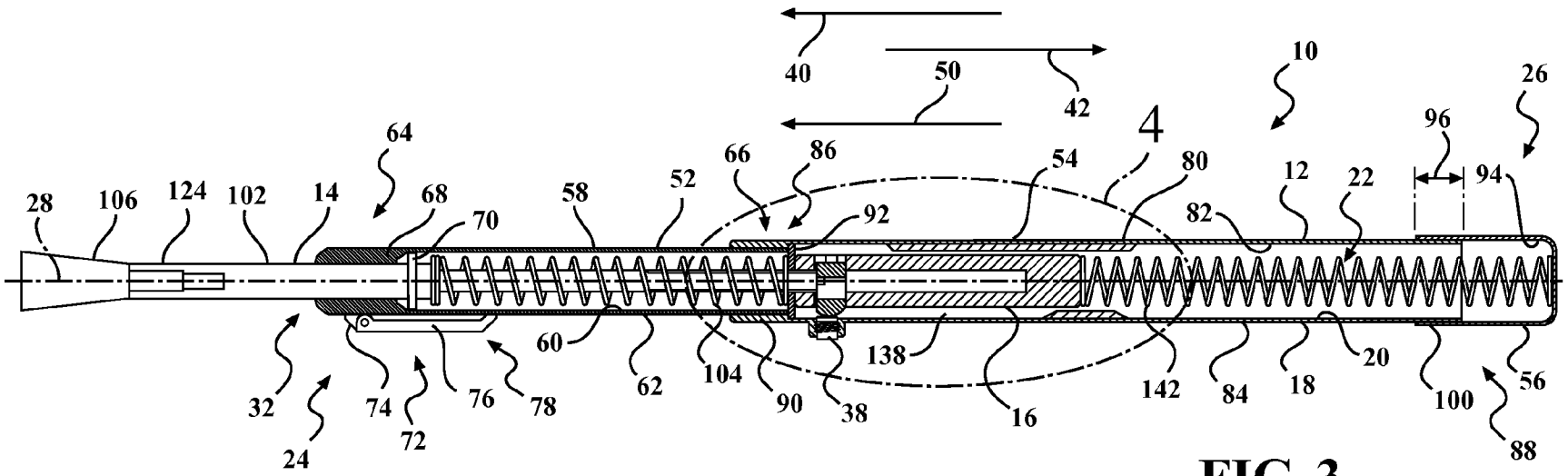
FIG. 3 is a schematic view of the tool assembly shown in FIG. 1.

FIG. 1 is a perspective view of the tool assembly 10. FIG. 2 is an exploded perspective view of the tool assembly 10. FIG. 3 is a schematic view of the tool assembly 10. In the illustrated embodiment, the tool assembly 10 includes a housing assembly 12, a rod assembly 14 that is slideably coupled to the housing assembly 12, and an impact assembly 16 that is slideably coupled to the housing assembly 12 and is configured to selectively contact the rod assembly 14 to move the rod assembly 14 outwardly from the housing assembly 12. The housing assembly 12 includes a sidewall 18 that includes an inner surface 20 that defines a cavity 22 that extends between a first end 24 and a second end 26 along the longitudinal axis 28. The cavity 22 is sized and shaped to receive the rod assembly 14 and the impact assembly 16 therein. The housing first end 24 defines an opening 32 that is coupled to the housing cavity 22 and is sized and shaped to receive the rod assembly 14 therethrough.

The rod assembly 14 is at least partially positioned within the housing cavity 22, and is movable along the longitudinal axis 28 such that at least a portion of the rod assembly 14 extends outwardly from the housing first end 24. The impact assembly 16 is positioned within the housing cavity 22, and is orientated between the rod assembly 14 and the housing second end 26 along the longitudinal axis 28. The impact assembly 16 is movable along the longitudinal axis 28 within the housing cavity 22.

Figure 9:
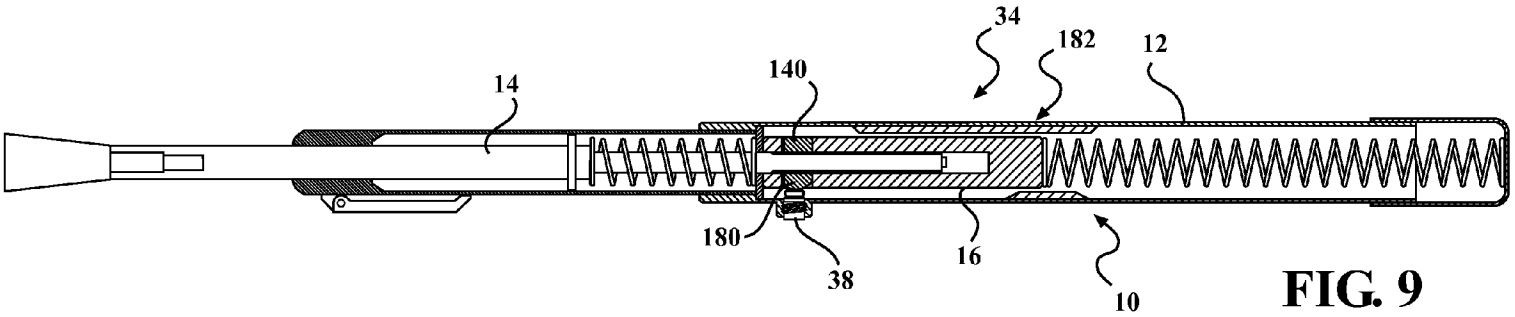
FIG. 9 is a schematic view of the tool assembly shown in FIG. 1 in a first operating mode.
Figure 10:
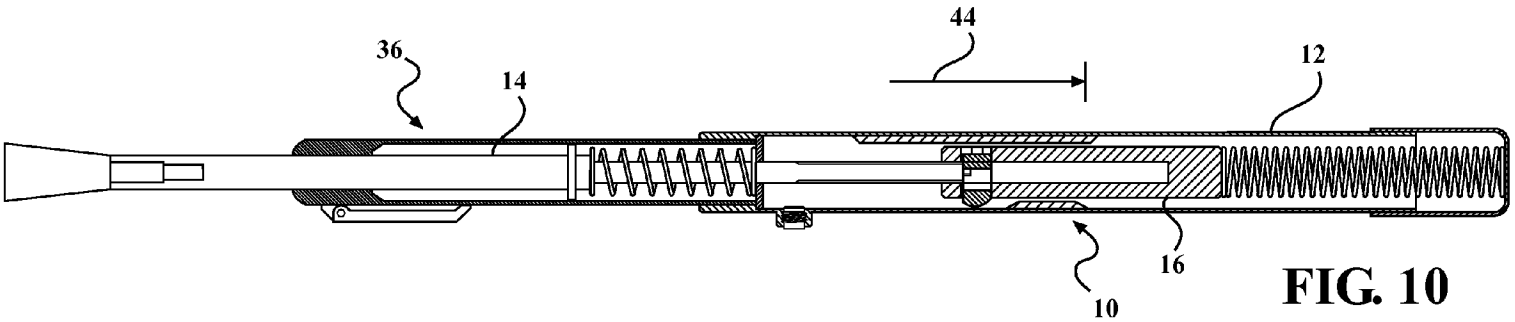
FIGS. 10-11 are schematic views of the tool assembly shown in FIG. 1 in a second operating mode.
Figure 11:
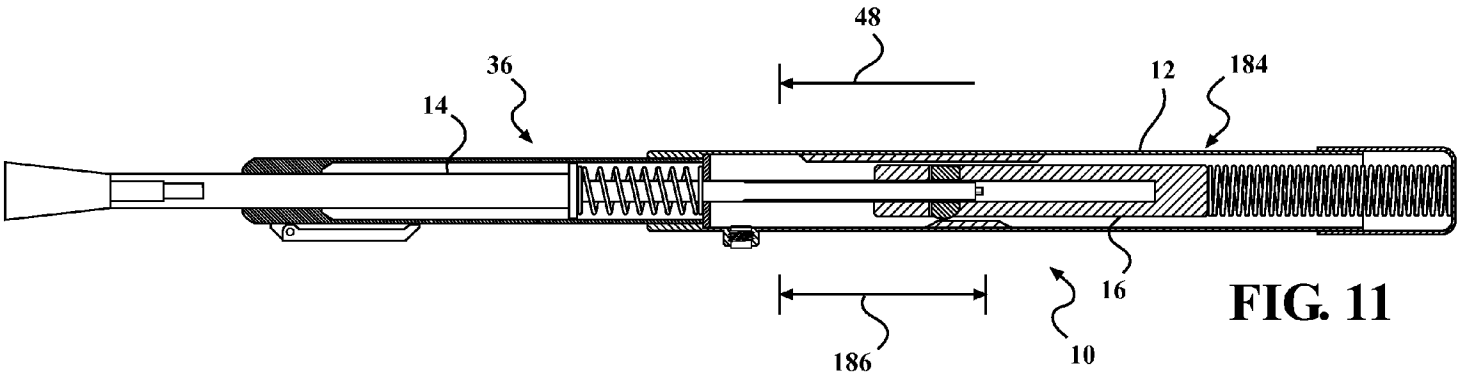

FIG. 9 is a schematic view of the tool assembly 10 in a first operating mode. FIGS. 10-11 are schematic views of the tool assembly 10 in a second operating mode. With reference to FIGS. 3 and 9-12, in the illustrated embodiment, the tool assembly 10 is configured to operate in a plurality of operating modes including the first operating mode, i.e., a tamping mode 34 (shown in FIG. 9) and the second operating mode, i.e., a driving mode 36 (shown in FIGS. 10-11). In one embodiment, the tool assembly 10 includes a mode selector 38 that is coupled to the housing assembly 12 and is configured to selectively contact the impact assembly 16 to position the tool assembly 10 between the tamping mode 34 and the driving mode 36.

In the tamping mode 34, the rod assembly 14 is movable along the longitudinal axis 28 with respect to the housing assembly 12 and with respect to the impact assembly 16. More specifically, in the tamping mode 34, the rod assembly 14 moves in a first direction, i.e. a forward direction 40 (shown in FIG. 3) along the longitudinal axis 28, and in a second direction, i.e. an aft direction 42 (shown in FIG. 3) that is opposite the forward direction 40 along the longitudinal axis 28. In addition, in the tamping mode 34, the rod assembly 14 moves along the forward direction 40 and the aft direction 42 with the impact assembly 16 in a stationary position with respect to the housing assembly 12. During the tamping mode 34, the user moves the housing assembly 12 in the forward direction 40 to generate an axial force, represented by arrow 50, that is imparted to a surface (not shown) from the tool assembly 10.

In the driving mode 36, the rod assembly 14 moves the impact assembly 16 in the aft direction 42, and the impact assembly 16 contacts the rod assembly 14 to move the rod assembly 14 in the forward direction 40. More specifically, during the driving mode 36, the rod assembly 14 engages the impact assembly 16 to move the impact assembly 16 in the aft direction 42 a predefined aft distance 44 along the longitudinal axis 28. When the impact assembly 16 reaches a predefined location 46 along the axis 28, the impact assembly 16 disengages the rod assembly 14 and moves in the forward direction 40 a predefined forward distance 48 with respect to the rod assembly 14 to contact the rod assembly 14 to move the rod assembly 14 in the forward direction 40. As the impact assembly 16 contacts the rod assembly 14, the impact assembly 16 imparts an axial force 50 to the rod assembly 14 to drive the rod assembly 14 outwardly from the housing assembly 12.

Figure 4:
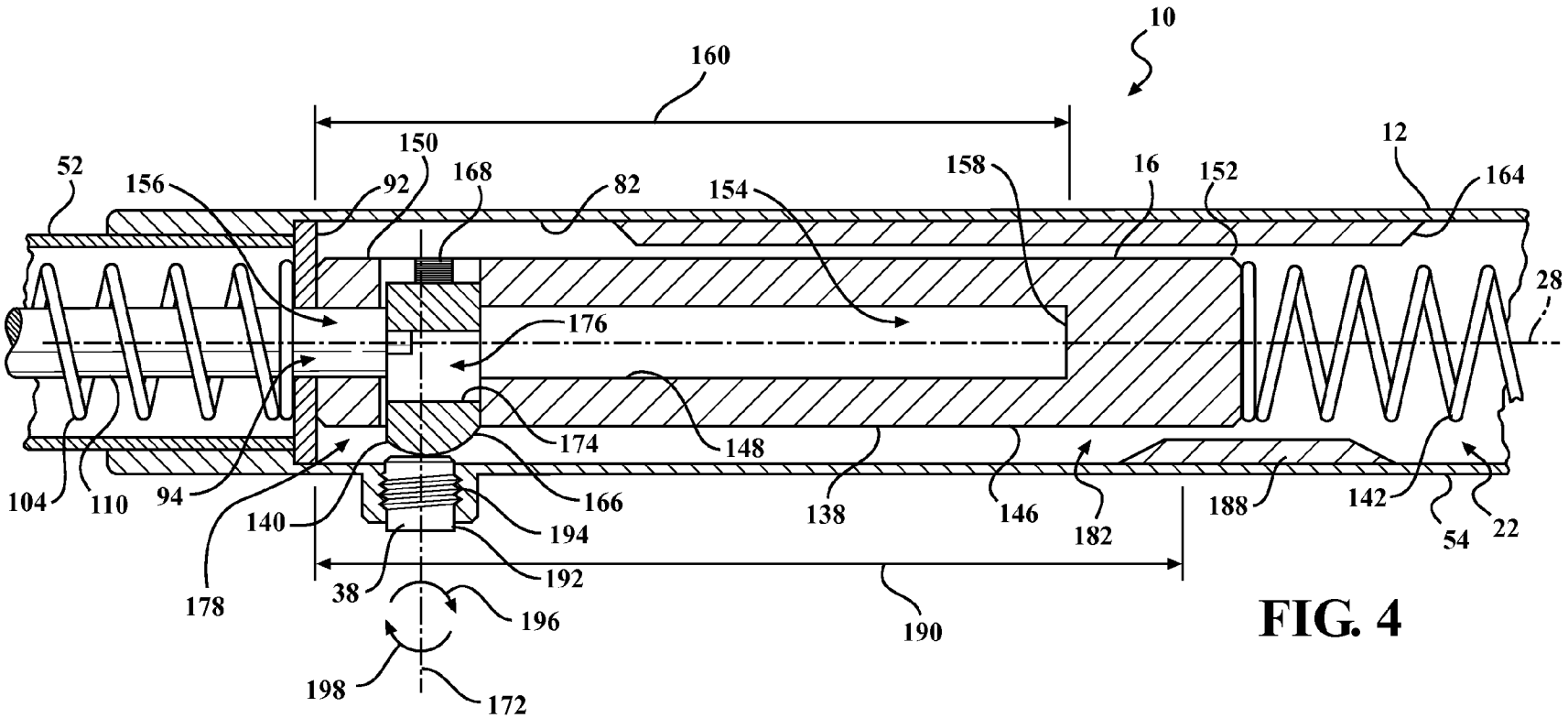
FIG. 4 is an enlarged partial schematic view of the tool assembly shown in FIG. 3, and taken along area 4.

FIG. 4 is an enlarged partial schematic view of the tool assembly 10 taken along area 4 shown in FIG. 3. With reference to FIGS. 1-4, in the illustrated embodiment, the housing assembly 12 includes a first housing member 52, a second housing member 54 that is coupled to the first housing member 52, and an end cap 56 that is coupled to the second housing member 54. In the illustrated embodiment, the housing assembly 12 is formed from steel. Alternatively, the housing assembly 12 may be formed from aluminum, a metal alloy, and/or any suitable material that enables the tool assembly 10 to function as described herein. The first housing member 52 includes a sidewall 58 that includes an inner surface 60 and an outer surface 62, and extends between a first end 64 and a second end 66 along the longitudinal axis 28. The first end 64 defines the housing first end 24. The first housing member 52 is configured to at least partially receive the rod assembly 14 therein. The first end 64 includes a shoulder portion 68 that extends radially inwardly from the inner surface 60. The shoulder portion 68 is configured to support the rod assembly 14 within the first housing member 52 such that the rod assembly 14 is maintained in alignment along the longitudinal axis 28. The shoulder portion 68 includes an end surface 70 that is configured to contact the rod assembly 14 to retain at least a portion of the rod assembly within the housing assembly 12.

In the illustrated embodiment, a pedal assembly 72 is coupled to the outer surface 62 of the first housing member 52. The pedal assembly 72 includes a support member 74 that is coupled to the first housing member 52, and a pedal 76 that is pivotably coupled to the support member 74. In one embodiment, the pedal 76 is coupled to the support member 74 with a pin (not shown). Alternatively, the pedal assembly 72 may include a spring (not shown) that is coupled to the pedal 76 and the support member 74 to bias the pedal 76 towards the housing assembly 12. The pedal 76 is positionable between an extended position (not shown) wherein the pedal 76 extends outwardly from the housing assembly 12, and a retracted position 78, wherein the pedal 76 is orientated adjacent to the housing outer surface 62. In the extended position, the pedal assembly 72 is configured to impart an axial force from a user to the tool assembly 10 to assist the user in operating the tool assembly 10. In the illustrated embodiment, the pedal assembly 72 is orientated near the housing first end 24. Alternatively, the pedal assembly 72 may be orientated at any suitable location along the housing outer surface 62 that enables the tool assembly 10 to function as described herein.

The second housing member 54 is removably coupled to the first housing member second end 66 and extends outwardly from the first housing member 52 along the longitudinal axis 28. The second housing member 54 is configured to receive the impact assembly 16 therein. The second housing member 54 includes a sidewall 80 that includes an inner surface 82 and an outer surface 84, and extends between a first end 86 and a second end 88 along the longitudinal axis 28. In the illustrated embodiment, the second housing member inner surface 82 is configured to at least partially receive the first housing member 52 therein. In one embodiment, the first housing member outer surface 62 and the second housing member inner surface 82 each include corresponding threaded surfaces 90 to facilitate coupling the first housing member 52 to the second housing member 54. Alternatively, the first housing member 52 may be coupled to the second housing member 54 with a weld, a bolt, a pin, a fastener, an adhesive, and or any suitable manner in which to couple the first housing member 52 to the second housing member 54. In the illustrated embodiment, the first end 86 includes an end wall 92 that extends inwardly from the inner surface 82 and is orientated substantially perpendicularly to the longitudinal axis 28. The end wall 92 defines an opening 94 that is sized and shaped to receive at least a portion of the rod assembly 14 therethrough. The end wall 92 is orientated to prevent the impact assembly 16 from extending into the first housing member 52.

The end cap 56 is removably coupled to the second housing member second end 88. The end cap 56 includes an inner surface 94 that is sized and shaped to at least partially receive the second end 88 therein such that a portion of the end cap 56 extends a distance 96 across the second housing member outer surface 84. In one embodiment, the end cap 56 is coupled to the second housing member 54 such that the overlap distance 98 is adjustable to adjust an axial force of the impact assembly 16. The end cap inner surface 94 and the second end outer surface 84 each include corresponding threaded areas 100 to facilitate coupling the end cap 56 to the second housing member 54. Alternatively, the end cap 56 is coupled to the second housing member 54 with a weld, a bolt, a pin, a fastener, an adhesive, and/or any suitable manner.

Figure 7:
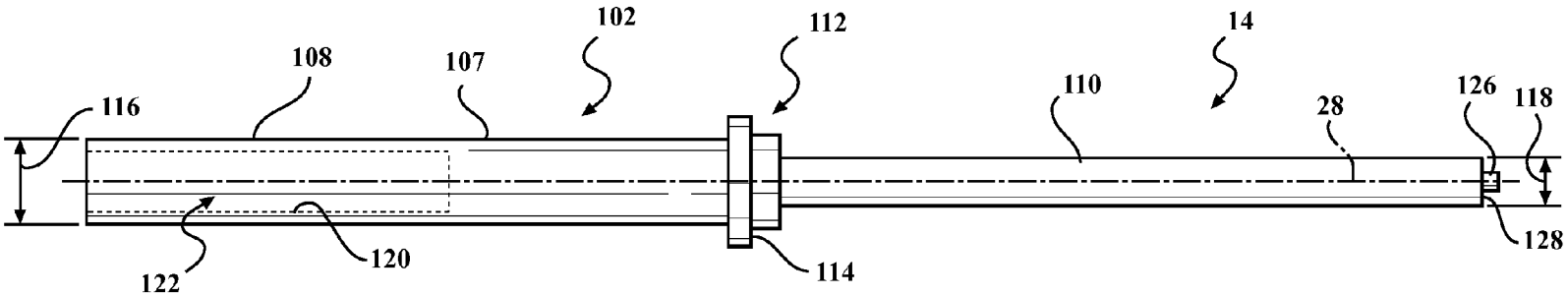
FIG. 7 is a schematic view of a rod assembly that may be used with the tool assembly shown in FIG. 1, according to an embodiment of the present invention.

FIG. 7 is a schematic view of the rod assembly 14. With reference to FIGS. 3, 4, and 7, in the illustrated embodiment, rod assembly 14 includes a rod member 102 that extends along the longitudinal axis 28, and a biasing element 104 that is coupled to the rod member 102 and is configured to bias the rod member 102 in the forward direction 40 along the longitudinal axis 28. In addition, the rod assembly 14 includes a tool attachment 106 that is removably coupled to the rod member 102. In the illustrated embodiment, the rod member 102 is formed from steel. Alternatively, the rod member 102 may be formed from aluminum, a metal alloy, and/or any suitable material that enables the tool assembly 10 to function as described herein. In one embodiment, the biasing element 104 includes a spring. Alternatively, biasing element 104 may include a hydraulic-type piston, a pneumatic-type piston, and/or any suitable biasing assembly that enables the tool assembly 10 to function as describe herein. In the illustrated embodiment, rod member 102 includes a substantially circular outer surface 107 that includes a forward section 108, an aft section 110 that extends outwardly from the forward section 108, and middle section 112 that is orientated between the forward section 108 and the aft section 110. The middle section 112 is orientated within the housing cavity 22 and includes a flange 114 that extends outwardly from the outer surface 107. The flange 114 is sized and shaped to contact the housing shoulder portion 68 to prevent the middle section 112 from extending outwardly from the housing first end 24. In one embodiment, the forward section 108 includes a first diameter 116, and the aft section 110 includes a second diameter 118 that is less than the forward section diameter 116. Alternatively, the aft section diameter 118 may be larger than, or equal to, the forward section diameter 116. In the illustrated embodiment, the forward section 108 includes an inner surface 120 that defines an cavity 122 therein. The cavity 122 is sized and shaped to receive the tool attachment 106 therein. In one embodiment, the rod inner surface 120 and the tool attachment 106 each include corresponding threaded surfaces 124 to facilitate coupling the tool attachment 106 to the rod assembly 14. Alternatively, the tool attachment 106 may be coupled to the rod member 102 with a pin, a bolt, a weld, an adhesive, and/or any suitable fastening device that enables the tool assembly 10 to function as described herein. In one embodiment, the rod assembly 14 also includes a stop member 125 (shown in FIGS. 1-2) that is coupled to the forward section 108. The stop member 125 extends outwardly from rod member outer surface 107 and is configured to contact the housing first end 24 to prevent movement of the rod assembly 14 in the aft direction 42 and to facilitate reducing an overcompression of the biasing element 104. The stop member 125 is coupled to rod member 102 with one of a corresponding threaded surfaces (not shown), a pin, a bolt, a weld, an adhesive, and/or any suitable fastening device that enables the rod assembly 14 to function as described herein.

In the illustrated embodiment, the aft section 110 extends through biasing element 104 to enable rod member 102 to move along longitudinal axis 28 in the forward direction 40 and the aft direction 42. The aft section 110 is also sized and shaped to extend through second housing member end wall 92 and into impact assembly 16. In one embodiment, the aft section 110 includes a positioning member 126 that extends outwardly from an axial face 128 of the aft section 110 along the longitudinal axis 28. The positioning member 126 is configured to engage the impact assembly 16 when the tool assembly 10 is in the driving mode 36.

The biasing element 104 is orientated between the rod member flange 114 and the end wall 92 and is configured to bias the rod member 102 away from the end wall 92 and towards the housing first end 24 along the longitudinal axis 28 in the forward direction 40.

Figure 8:
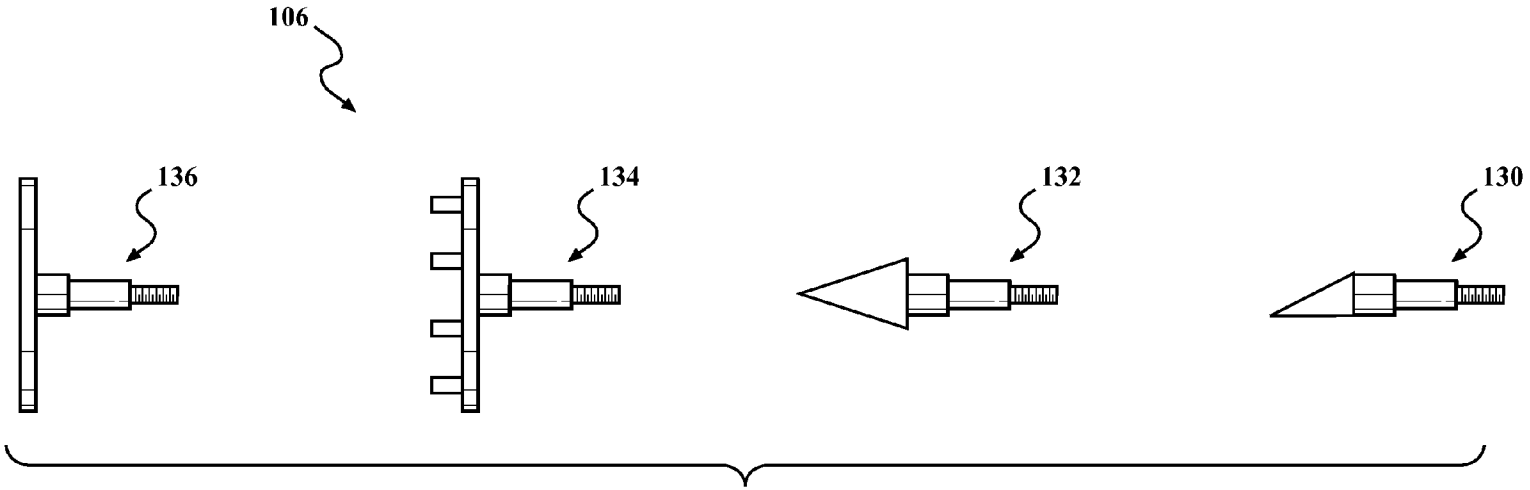
FIG. 8 is a schematic view of a plurality of tool attachments that may be used with the tool assembly shown in FIG. 1, according to an embodiment of the present invention.

FIG. 8 is a schematic view of a plurality of tool attachments 106. In the illustrated embodiment, the rod assembly 14 may include a plurality of tool attachments 106 that are coupled to rod member 102. The plurality of tool attachments 106 may include a digging bar 130, a wood splitter 132, a lawn aerator 134, a tamper 136, and or any suitable attachment.

Figure 5:
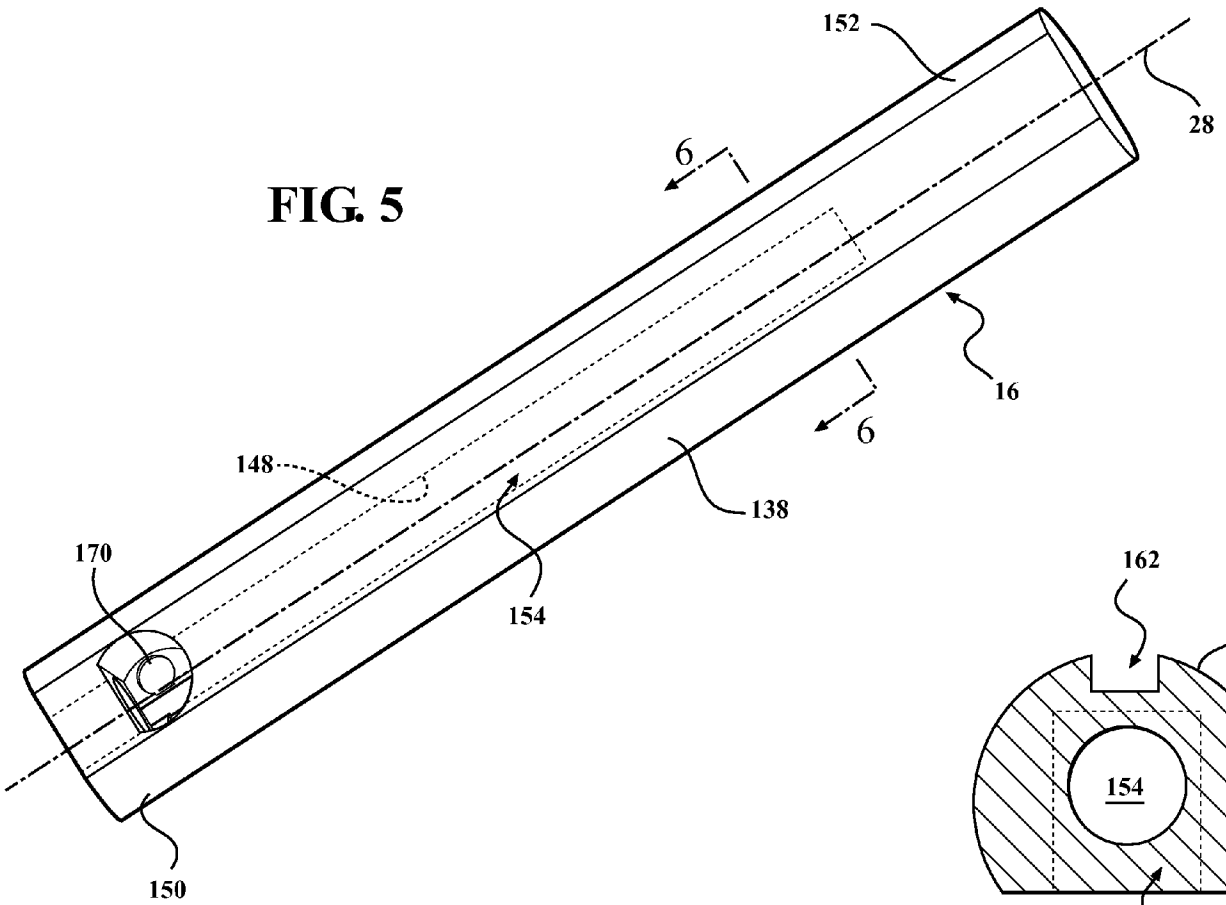
FIG. 5 is a partial perspective view of an impact assembly that may be used with the tool assembly shown in FIG. 1, according to an embodiment of the present invention.
Figure 6:
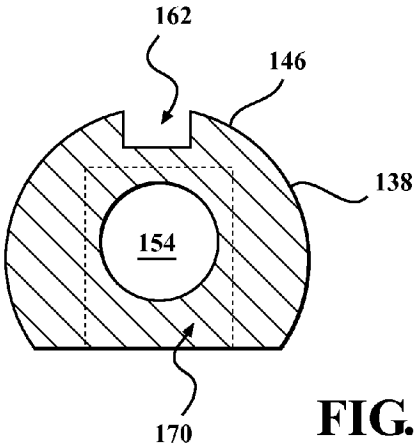
FIG. 6 is a partial cross-sectional view of the impact assembly shown in FIG. 5, and taken along line 6-6.

FIG. 5 is a partial perspective view of the impact assembly 16. FIG. 6 is a partial cross-sectional view of the impact assembly 16 taken along line 6-6 shown in FIG. 5. With reference to FIGS. 4-6, in the illustrated embodiment, the impact assembly 16 includes an impact member 138, a cam assembly 140 that is coupled to the impact member 138, and a biasing member 142 that is coupled between the impact member 138 and the housing end cap 56. The biasing member 142 is configured to bias the impact member 138 towards the rod assembly 14 in the forward direction 40 along the longitudinal axis 28. In one embodiment, the biasing member 142 includes a spring 144. Alternatively, the biasing member 142 may include a hydraulic-type piston, a pneumatic-type piston, and/or any suitable biasing assembly that enables the tool assembly 10 to function as describe herein.

In the illustrated embodiment, the impact member 138 includes a substantially circular outer surface 146 and an inner surface 148, and extends between a forward end 150 and aft end 152 along the longitudinal axis 28. In the illustrated embodiment, the impact member 138 is formed from steel. Alternatively, the impact member 138 may be formed from aluminum, a metal alloy, and/or any suitable material that enables the tool assembly 10 to function as described herein. The inner surface 148 defines a bore 154 that extends from the forward end 150 towards the aft end 152 along the longitudinal axis 28. Moreover, the forward end 150 includes an opening 156 that is coupled to the bore 154, and the aft end 152 includes an inner wall 158 that at least partially defines the bore 154, and is spaced a distance 160 from the opening 156 along the longitudinal axis 28. The bore 154 is sized and shaped to receive the rod member 102 therein.

In one embodiment, the impact member 138 includes a groove 162 that is defined along the outer surface 146. The groove 162 is sized and shaped to receive a splined surface 164 that extends inwardly from the housing inner surface 82 to prevent the impact member 138 from rotating about the longitudinal axis 28.

The cam assembly 140 is coupled to the impact member 138 and is configured to selectively provide access to the bore 154. The cam assembly 140 includes a cam member 166 and a spring member 168 that is coupled to the impact member 138 and the cam member 166 to bias the cam member 166 outwardly from the impact member 138. The impact member 138 includes an opening 170 that extends inwardly from the impact member outer surface 146. The opening 170 is sized and shaped to receive the cam assembly 140 therein. The cam assembly 140 is positioned within the opening 170 and is orientated along a transverse axis 172 that is substantially perpendicular to the longitudinal axis 28. The cam member 166 includes an inner surface 174 that defines a cam opening 176 that extends through the cam member 166. The cam opening 176 is orientated along the longitudinal axis 28, and is sized and shaped to receive the rod member 102 therethrough.

In the illustrated embodiment, the cam assembly 140 is movable along the transverse axis 172 and is positionable between a first cam position 178 (shown in FIG. 4) and a second cam position 180 (shown in FIG. 9). In the first cam position 178, the cam member 166 is orientated with respect to the impact member 138 such that the cam opening 176 is not coaxially aligned with the impact member bore 154 and is offset from the bore 154 such that the rod assembly 14 is prevented from extending into the bore 154. In the first cam position 178, the cam member 166 contacts the rod member 102 such that a movement of the rod member 102 along the longitudinal axis 28 causes a movement of the impact assembly 16 along the longitudinal axis 28. Moreover, in the first cam position 178, cam inner surface 174 contacts positioning member 126 to align cam member 166 with respect to rod member 102. In the second cam position 180, the cam member 166 is orientated with respect to the impact member 138 such that the cam opening 176 is coaxially aligned with the bore 154 to allow the rod member 102 to extend through the cam opening 176 and into the impact member bore 154.

The impact assembly 16 is movable along the longitudinal axis 28 between a first position 182 (shown in FIG. 4) and a second position 184 (shown in FIG. 11). In the first position 182, the impact member 138 is adjacent the second housing member end wall 92. In the second position 184, the impact member 138 is positioned a distance 186 from the end wall 92 along the longitudinal axis 28.

The housing sidewall 18 also includes a cam surface 188 that extends inwardly from the housing inner surface 20 towards the impact assembly 16. The cam surface 188 is positioned a distance 190 from the housing end wall 92 along the longitudinal axis 28, and is sized and shaped to move the cam assembly 140 from the first cam position 178 to the second cam position 180 as the impact assembly 16 moves from the first position 182 to the second position 184.

In the illustrated embodiment, the tool assembly 10 also includes a mode selector 38 that is coupled to the housing assembly 12 and is configured to selectively position the cam assembly 140 in the first cam position 178 or the second cam position 180. More specifically, the mode selector 38 includes a selection member 192 that extends through the housing sidewall 18 along the transverse axis 172, and is configured to selectively contact the cam assembly 140. The selection member 192 is orientated with respect to the second housing member end wall 92 such that the selection member 192 is aligned with the cam assembly 140 with the impact assembly 16 in the first position 182 to move the cam assembly 140 between the first cam position 178 and second cam position 180. The selection member 192 includes a threaded outer surface 194 and is rotatably coupled to the housing sidewall 18 such that a rotation of the mode selector 38 in a first direction 196 about the transverse axis 172 extends the selection member 192 towards the impact member 138 and a rotation of the mode selector 38 in a second opposite direction 198 retracts the selection member 192 away from the impact member 138. In this manner, the user may position the tool assembly 10 in one of the tamping mode 34 and the driving mode 36 by rotating the mode selector 38 in the first direction 196 or the second direction 198.

During operation in the tamping mode 34 (shown in FIG. 9), the mode selector 38 extends into the housing cavity 22 to position the cam assembly 140 in the second cam position 180 to enable the rod assembly 14 to extend through the impact member 138 with the impact member 138 in the first position 182. More specifically, during the tamping mode 34, with the cam assembly 140 in the second cam position 180, the impact member 138 remains stationary as the rod assembly 14 moves through the impact member 138 in a reciprocating motion. In general, during operation in the tamping mode 34, a user positions the tool assembly 10 with respect to a supporting surface such as, for example, a ground surface, such that the rod assembly 14 is initially in contact with the ground surface. The user then applies an axial force 50 (shown in FIG. 3) to the housing assembly 12 in the forward direction 40 to move the housing assembly 12 towards the ground surface. As the housing assembly 12 is moved towards the ground surface, the rod assembly 14 extends into the housing cavity 22 and the rod assembly biasing element 104 generates an opposing force in the aft direction 42 to bias the housing assembly 12 away from the ground surface. In addition, the rod member 102 extends further into the impact member 138 with the impact member 138 in the first position 182. The user then releases the axial force to enable the rod assembly 14 to move the housing assembly 12 away from the ground surface in the aft direction 42. As the housing assembly 12 is moved in the aft direction 42, an axial momentum of the housing assembly 12 causes the tool assembly 10 to lift a distance above the ground surface to acquire an amount of potential energy before again moving in the forward direction 40 towards the ground surface due to gravity. As the tool assembly 10 moves in the forward direction 40, the user again applies an axial force to the tool assembly 10 to contact the tool assembly 10 with the ground surface. As the rod assembly 14 contacts the ground surface, the rod assembly 14 imparts an axial force to the ground surface that is approximately equal to the acquired potential energy and the axial force applied by the user. As the rod assembly 14 contacts the ground surface, the rod assembly 14 also biases the housing assembly 12 away from the ground surface such that the tool assembly 10 recoils along the longitudinal axis 28 in the aft direction 42. In this manner, the user operates the tool assembly 10 in a reciprocating manner to apply an axial force to the ground surface.

During operation in the driving mode 36 (shown in FIGS. 10-11), the mode selector 38 is substantially flush with the housing inner surface 20 such that the cam assembly 140 is positioned in the first cam position 178 with the impact member 138 in the first position 182. As the user applies a first axial force to move the housing assembly 12 towards the ground surface, the rod assembly 14 moves the impact assembly 16 from the first position 182 to the second position 184 in the aft direction 42. As the impact assembly 16 is moved in the aft direction 42, the impact assembly biasing element 142 generates an increasing second axial force that biases the impact assembly 16 towards the rod assembly 14. As the impact member 138 is moved to the second position 184, the cam surface 188 moves the cam assembly 140 to the second cam position 180 such that the cam assembly 140 disengages the rod assembly 14 and the impact member 138 moves towards the rod assembly 14 by the generated second axial force. The impact assembly inner wall 158 then contacts the rod assembly 14 and imparts the generated second axial force to the rod assembly 14. The rod assembly 14 imparts the generated second axial force to the ground surface to deliver an impact blow to the ground surface that is approximately equal to the second axial force. After the impact blow is delivered to the ground surface, the rod assembly 14 biases the housing assembly 12 in the aft direction 42 such that the tool assembly 10 recoils from the ground surface and such that the impact member 138 is repositioned to the first position 182. In this manner, the user operates the tool assembly 10 in a reciprocating manner to apply the first axial force and the second axial force to the ground surface.

Figure 12:
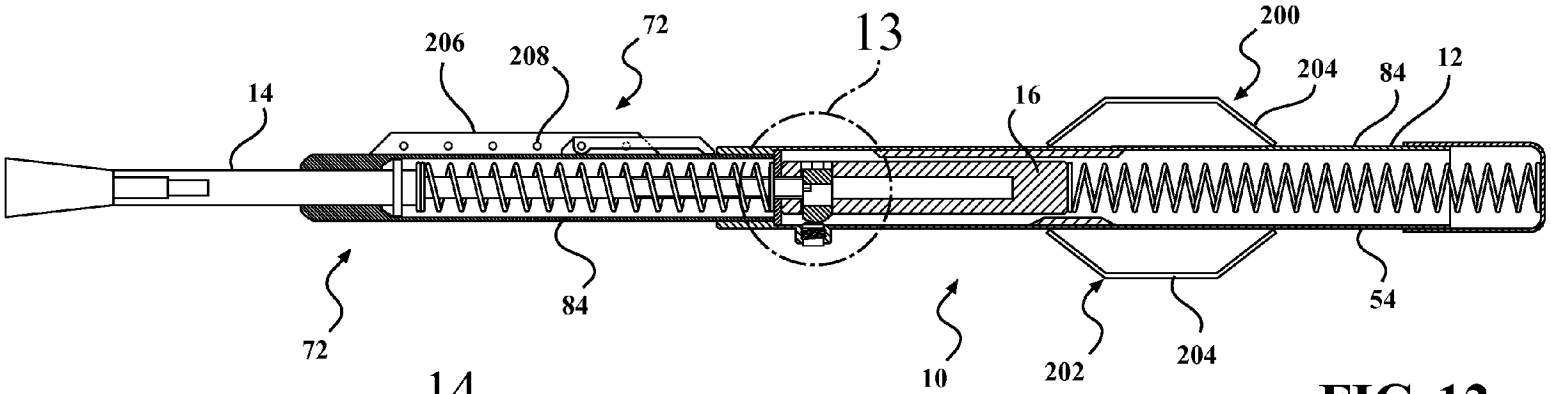
FIG. 12 is another schematic view of the tool assembly, according to an embodiment of the present invention.
Figure 14:
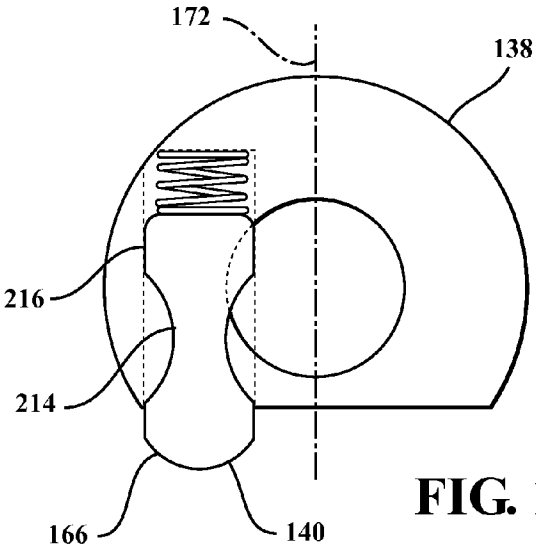
Figure 13:
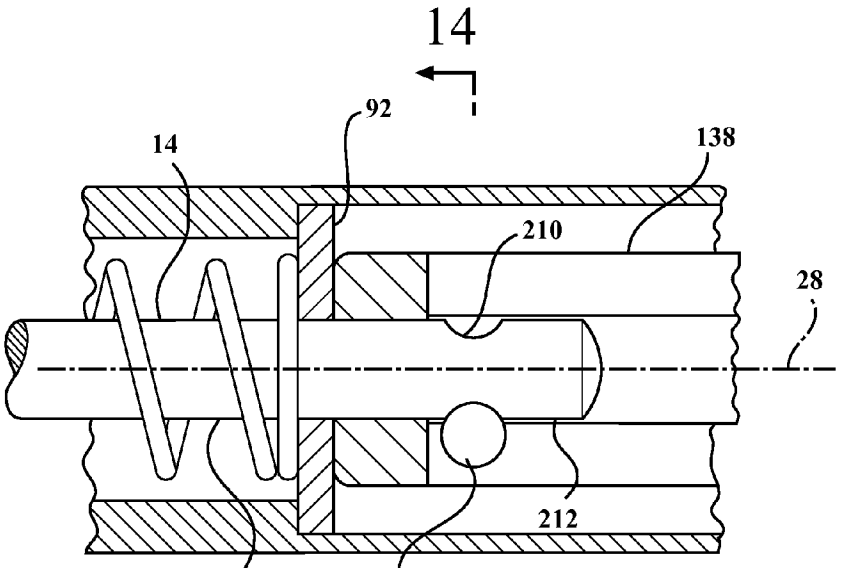
FIG. 13 is an enlarged partial schematic view of the tool assembly shown in FIG. 12, and taken along area 12; and, FIG. 14 is a cross-sectional view of the impact assembly shown in FIG. 13, and taken along line 14-14.

FIG. 12 is another schematic view of the tool assembly 10. FIG. 13 is an enlarged partial schematic view of the tool assembly 10 taken along area 13 shown in FIG. 12. FIG. 14 is a cross-sectional view of the impact assembly 16 taken along line 14-14 shown in FIG. 13. In one embodiment, the tool assembly 10 includes a handle assembly 200 that is coupled the second housing member 54. The handle assembly 200 includes a pair 202 of D-shaped members 204 that are coupled to housing outer surface 84, and are configured to impart an axial force from the user to the rod assembly 14 housing assembly 12 during operation. The pedal assembly 72 includes a support flange 206 that is coupled to the housing outer surface 84 and includes a plurality of openings 208 that extend through the support flange 206. Each opening 208 is sized and shaped to receive a pin (not shown) therethrough to enable the user to selectively position the pedal 76 along the support flange 206.

In one embodiment, the rod assembly 14 includes at least one groove 210 that is defined along an outer surface 212 of the aft section 110. The cam assembly 140 includes a corresponding groove 214 that is defined along an outer surface 216 of the cam member 166. In the first cam position 178 the cam groove 214 is aligned with the rod assembly groove 210 to enable the rod assembly 14 to extend into the impact member bore 154. In the second cam position 180, the cam groove 214 is not aligned with the rod assembly groove 210 such that the rod member 102 is prevented from extending through the bore 154. Alternatively, the cam assembly 140 may include a pair of cam members 166 that are orientated on opposite sides of the rod assembly 14.

The above-described apparatus and methods overcome at least some disadvantages of known compaction tools by providing a tool assembly includes a rod assembly that is slideably coupled to a housing assembly, and is configured to bias the housing assembly from the ground surface to enable the user to operate the tool assembly in a reciprocating motion, and to reduce an effort require to compact the ground surface over known compaction tools. In addition, the tool assembly that is selectively operable between a tamping mode wherein the tool assembly impacts a first axial force to a ground surface, and a driving mode, wherein the tool assembly imparts the first axial force and a second axial force to the ground surface. As such, By providing a tool assembly that operates in a plurality of operational modes, and that is operated in a reciprocating motion, the effort required to impart a force to the ground surface is reduced.

Exemplary embodiments of a tool assembly and methods of assembling the same are described above in detail. The systems and methods are not limited to the specific embodiments described herein, but rather, components of the apparatus and/or steps of the methods may be utilized independently and separately from other components and/or steps described herein. For example, the methods may also be used in combination with other compacting devices, and are not limited to practice with only the tool assembly as described herein. Rather, the exemplary embodiment can be implemented and utilized in connection with many other digging and/or compacting applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While the invention has been described in terms of various specific embodiments, those skilled in the art will recognize that the invention may be practiced with modification within the spirit and scope of the claims.

What is claimed is:

1. A tool assembly comprising:

a housing assembly comprising a sidewall comprising a first end, a second end, and an inner surface that defines a cavity that extends between the first end and the second end along a longitudinal axis;

a rod assembly slideably coupled to said housing assembly and orientated within said housing cavity such that a portion of said rod assembly extends outwardly from the housing first end;

an impact assembly positioned within said housing cavity and orientated between said rod assembly and the housing second end, said impact assembly configured to selectively contact said rod assembly to move said rod assembly along the longitudinal axis, said tool assembly operable in a first operating mode wherein the rod assembly is movable with respect to the impact assembly, and a second operating mode wherein the impact assembly contacts the rod assembly to move the rod assembly outwardly from the housing; and, a mode selector assembly for selectively contacting said impact assembly to adjust an operation of said tool assembly between the first mode of operation and the second mode of operation, wherein said impact assembly is movable between a first position and a second position along the longitudinal axis, said impact assembly is positioned at the first position during the first mode of operation, and is movable between the first position and the second position during the second mode of operation, wherein, during the second mode of operation, said rod assembly moves said impact assembly from the first position to the second position.

2. A tool assembly in accordance with claim 1, wherein said impact assembly comprises an impact member comprising a forward end, an aft end, and an inner surface that defines a bore that extends between the forward end and the aft end along the longitudinal axis, said bore is configured to receive said rod assembly therein.

3. A tool assembly comprising:

a housing assembly comprising a sidewall comprising a first end, a second end, and an inner surface that defines a cavity that extends between the first end and the second end along a longitudinal axis;

a rod assembly slideably coupled to said housing assembly and orientated within said housing cavity such that a portion of said rod assembly extends outwardly from the housing first end;

an impact assembly positioned within said housing cavity and orientated between said rod assembly and the housing second end, said impact assembly configured to selectively contact said rod assembly to move said rod assembly along the longitudinal axis, said tool assembly operable in a first operating mode wherein the rod assembly is movable with respect to the impact assembly, and a second operating mode wherein the impact assembly contacts the rod assembly to move the rod assembly outwardly from the housing; and, a mode selector assembly for selectively contacting said impact assembly to adjust an operation of said tool assembly between the first mode of operation and the second mode of operation, wherein said impact assembly is movable between a first position and a second position along the longitudinal axis, said impact assembly is positioned at the first position during the first mode of operation, and is movable between the first position and the second position during the second mode of operation, wherein said impact assembly further comprises a cam assembly that is coupled to said impact assembly to selectively provide access to a bore in the impact assembly.

4. A tool assembly in accordance with claim 3, wherein said cam assembly is positionable between a first cam position wherein the cam assembly prevents the rod assembly from being inserted into the bore, and a second cam position wherein the cam assembly allows the rod assembly to extend into the bore.

5. A tool assembly in accordance with claim 4, wherein said mode selector assembly is configured to selectively position said cam assembly to operate said tool assembly in the first operating mode or the second operating mode.

6. A tool assembly in accordance with claim 4, wherein, during the first mode of operation, the cam assembly is orientated in the second cam position to allow the rod assembly to extend into the bore with the impact assembly in the first position.

7. A tool assembly in accordance with claim 4, wherein, during the second mode of operation, the rod assembly contacts the cam assembly to move the impact member from the first position to the second position, and the cam assembly moves from the first cam position to the second cam position as the impact member moves to the second position to allow the rod assembly to extend into the bore such that the impact member contacts the rod assembly to move the rod assembly along the longitudinal axis.

8. A tool assembly in accordance with claim 4, wherein said impact assembly further comprises a biasing member coupled between the housing second end and said impact member to bias said impact member towards said housing first end.

9. A tool assembly in accordance with claim 4, wherein said rod assembly comprises:

a rod member comprising a first portion, a second portion, and an outer surface extending between the first portion and the second portion, the first portion extending outwardly from the housing first end, the second portion orientated within the housing cavity and configured to extends into at least a portion of the impact assembly;

a tool attachment removably coupled to the rod member; and a biasing member coupled to the rod member and the housing assembly to bias the rod member outwardly from the housing assembly.

10. A tool assembly in accordance with claim 9, wherein said rod first portion comprises an inner surface that defines a rod cavity that is configured to at least partially receive the tool attachment therein.

11. A tool assembly comprising:

a housing assembly comprising a cavity that extends between a first end and a second end;

a rod assembly slideably coupled to said housing assembly and orientated within said housing cavity such that a portion of said rod assembly extends outwardly from the housing first end;

an impact assembly positioned within said housing cavity and movable between a first position and a second position along a longitudinal axis; and, a mode selector assembly coupled to said housing and configured to selectively contact said impact assembly to operate said tool assembly in one of a first operating mode and a second operating mode, wherein said impact assembly is positioned at the first position in the first operating mode, and the impact assembly is movable between the first position and the second position to contact the rod assembly in the second operating mode, wherein said impact assembly comprises an impact member comprising a forward end, an aft end, and an inner surface that defines a bore that extends between the forward end and the aft end along the longitudinal axis, said bore is configured to receive said rod assembly therein, wherein, during the first operating mode, said rod assembly is partially inserted through said impact assembly with the impact assembly in the first position, wherein, during the second mode of operation, said rod assembly moves said impact member from the first position to the second position.

12. A tool assembly comprising:

a housing assembly comprising a cavity that extends between a first end and a second end;

a rod assembly slideably coupled to said housing assembly and orientated within said housing cavity such that a portion of said rod assembly extends outwardly from the housing first end;

an impact assembly positioned within said housing cavity and movable between a first position and a second position along a longitudinal axis; and, a mode selector assembly coupled to said housing and configured to selectively contact said impact assembly to operate said tool assembly in one of a first operating mode and a second operating mode, wherein said impact assembly is positioned at the first position in the first operating mode, and the impact assembly is movable between the first position and the second position to contact the rod assembly in the second operating mode, wherein said impact assembly comprises an impact member comprising a forward end, an aft end, and an inner surface that defines a bore that extends between the forward end and the aft end along the longitudinal axis, said bore is configured to receive said rod assembly therein, wherein said impact assembly further comprises a cam assembly that is coupled to said impact member to selectively provide access to the bore.

13. A tool assembly in accordance with claim 12, wherein said cam assembly is positionable between a first cam position wherein the cam assembly prevents the rod assembly from being inserted into the bore, and a second cam position wherein the cam assembly allows the rod assembly to extend into the bore.

14. A tool assembly in accordance with claim 13, wherein, during the first mode of operation, the cam assembly is orientated in the second cam position to allow the rod assembly to extend into the bore with the impact member in the first impact member position.

15. A tool assembly in accordance with claim 14, wherein, during the second mode of operation, the rod assembly contacts the cam assembly to move the impact member from the first position to the second position, and the cam assembly moves from the first cam position to the second cam position as the impact member moves to the second position to allow the rod assembly to extend into the bore such that the impact member contacts the rod assembly to move the rod assembly along the longitudinal axis.

16. A tool assembly in accordance with claim 13, wherein said mode selector assembly is configured to selectively position said cam assembly to operate said tool assembly in the first operating mode or the second operating mode.

* * * * *